United States Patent [19]

White

[11] Patent Number: 4,511,607

[45] Date of Patent: Apr. 16, 1985

[54] WINDOW-MOUNTED CHRISTMAS TREE

[76] Inventor: John D. White, 3705 Brunswick Dr., Toledo, Ohio 43606

[21] Appl. No.: 599,274

[22] Filed: Apr. 11, 1984

[51] Int. Cl.[3] ..... A47G 33/06

[52] U.S. Cl. ..... 428/13; 428/20

[58] Field of Search ..... 428/18, 19, 20, 8, 9, 428/13; D11/118; 362/123; 211/196, 205

[56] References Cited

U.S. PATENT DOCUMENTS

| | | | |
|---|---|---|---|
| 2,864,192 | 12/1958 | Shoalts | 362/123 |
| 2,909,356 | 10/1959 | Salick | 428/20 X |
| 3,027,671 | 4/1962 | Duvall | 428/18 X |
| 3,479,990 | 11/1969 | Crow | 428/18 X |
| 3,857,748 | 12/1974 | Thomann | 428/20 X |
| 3,908,307 | 9/1975 | Jacobson | 428/18 X |
| 3,985,924 | 10/1976 | Pritza | 428/20 X |
| 4,109,036 | 8/1978 | Lloyd et al. | 428/20 X |
| 4,172,913 | 10/1979 | Ballah | 428/20 X |
| 4,435,452 | 3/1984 | Hernandez et al. | 428/18 X |

*Primary Examiner*—Henry F. Epstein

*Attorney, Agent, or Firm*—Allen D. Gutchess, Jr.

[57] ABSTRACT

A window-mounted artificial Christmas tree is provided to be located adjacent the inside of a picture window. The artificial Christmas tree extends substantially the full height of the window and has an upright supporting member engagable with a generally horizontal surface of a lower frame member below the window. A resiliently mounted extension member is located at the top of the upright supporting member and engages a generally horizontal surface of an upper frame member above the window. The upright supporting member supports a plurality of artificial tree branches with the lower branches being longer than the upper ones and preferably with the branches at any given height which extend generally parallel to the window being longer than those extending transversely to the window to provide a generally semi-elliptical shape in horizontal cross section. The artificial Christmas tree thereby takes up a minimum amount of space within the room. Further, it is fully exposed through the window to provide the advantages of an outside decorated tree without the disadvantages thereof.

17 Claims, 5 Drawing Figures

WINDOW-MOUNTED CHRISTMAS TREE

This invention relates to an artificial Christmas tree to be mounted in a window frame inside a picture window.

The artificial Christmas tree in accordance with the invention includes an upright supporting member from which a plurality of artificial tree branches extend. The branches are longer toward the end of the upright supporting member than at the upper end to provide the usual generally triangular shape of a Christmas tree. However, the branches also, at any given height, are longer in a plane parallel to the window than in a plane perpendicular to the window so that the branches form the general shape of a semi-ellipse when viewed in horizontal section. The artificial tree thus tends to appear as a full three-dimensional artificial tree when viewed from inside the house or from the outside. However, the branches extend into the room a lesser distance than would otherwise occur if all branches at a given height were of generally the same length. Consequently, the artificial window-mounted Christmas tree consumes a minimal amount of space within the room where it is located, an important consideration in these days of smaller houses, condominiums, and apartments.

The artificial window-mounted tree provides virtually the same enjoyment for occupants as a full Christmas tree or generally circular shape in horizontal section. Further, with a picture window, the tree can be seen fully from outside unlike most trees which are positioned on the floor and partially hidden at least by the wall below the window. Unlike a decorated outside tree, the window-mounted tree can be decorated within the comfort and heat of the home and there is no need to decorate two completely different trees to obtain both inside and outside decorative effects. In addition, the well-known problems of vandalism to outside Christmas decorations are completely eliminated.

In a preferred form, the upright supporting member of the Christmas tree has a resilient friction pad at the bottom thereof for engaging a lower frame member of the picture window. To accommodate differences in heights of the windows, the upper end of the upright supporting member preferably has a recess therein and an extension member with a cavity at an open end telescopes in the upright supporting member and has a friction pad at the upper end. A spring in the recess and cavity urges the extension member upwardly to engage an upper frame member of the picture window. The extension member can also include a separate spacing block to provide additional height needed for larger windows.

It is, therefore, a principal object of the invention to provide an artificial Christmas tree to be mounted in the framework of a picture window.

Another object of the invention is to provide an artificial Christmas tree to be mounted inside a window and fully visible from the outside.

Yet another object of the invention is to provide an artificial Christmas tree to be mounted adjacent a window pane with branches at a given height extending parallel to the pane being substantially longer than those extending generally perpendicularly to the pane, whereby less space is consumed within the room in which the tree is located.

Many other objects and advantages of the invention will be apparent from the following detailed description of a preferred embodiment thereof, reference being made to the accompanying drawings, in which.

Figure 1:
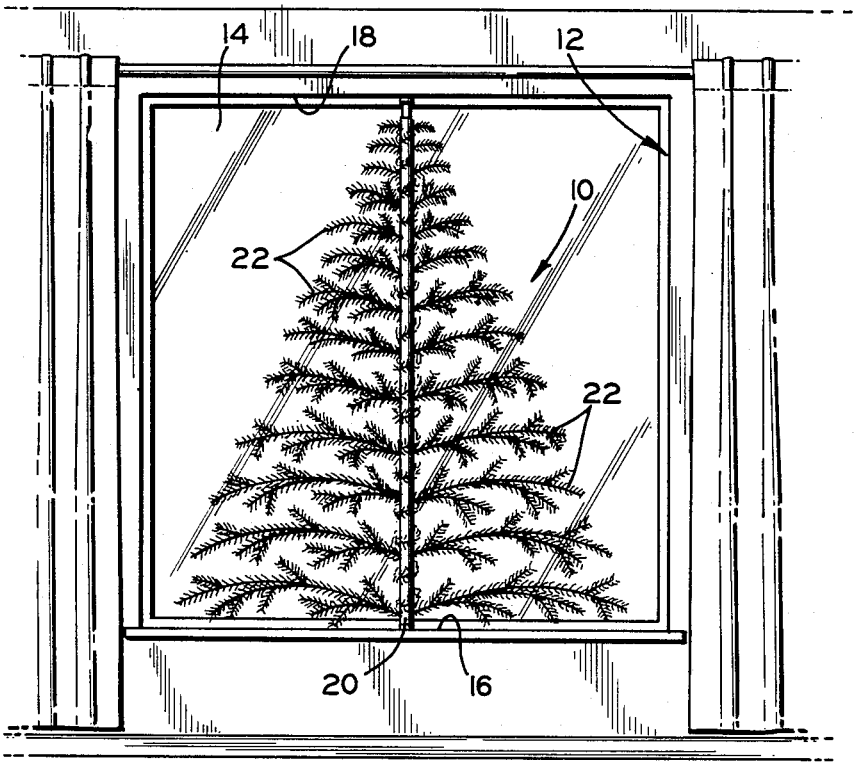
FIG. 1 is a somewhat schematic view in elevation, taken from inside a house, of a picture window with an artificial Christmas tree mounted therein, in accordance with the invention.
Figure 2:
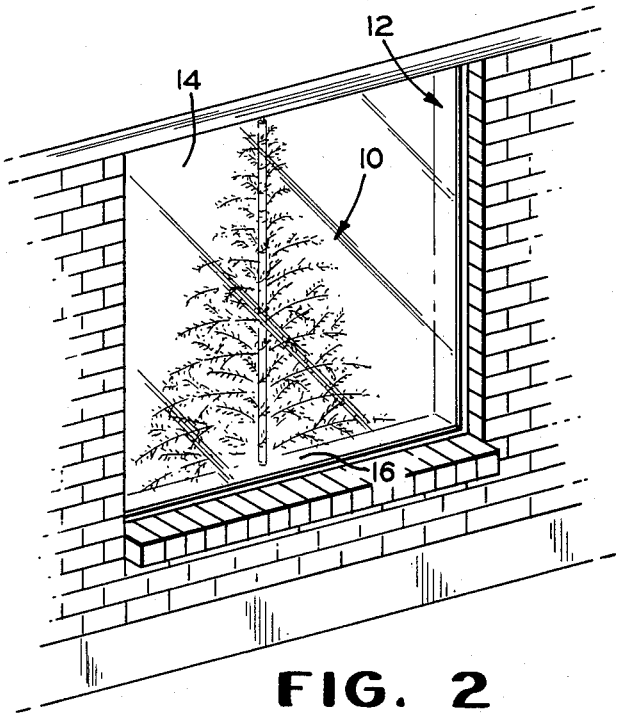
FIG. 2 is a somewhat schematic, outside view in perspective of the picture window and tree of FIG. 1.
Figure 3:
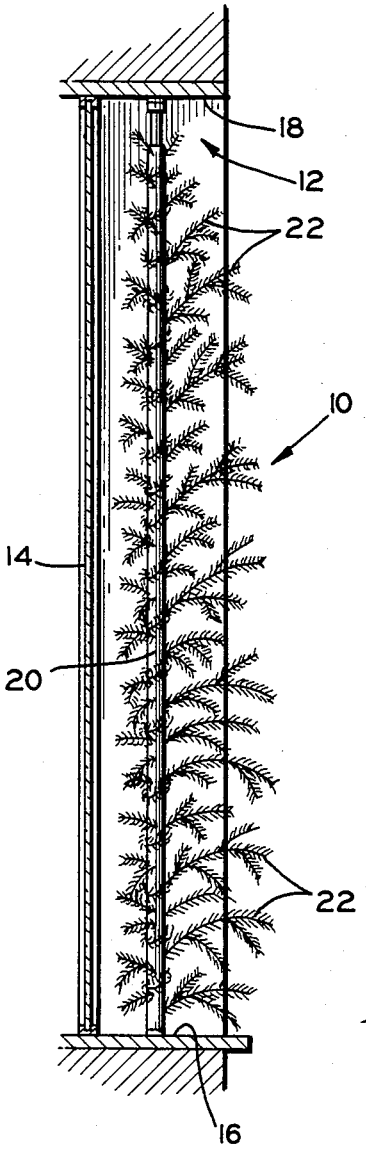
FIG. 3 is a somewhat schematic side view in elevation of the artificial Christmas tree with the picture window and frame shown in section.
Figure 5:
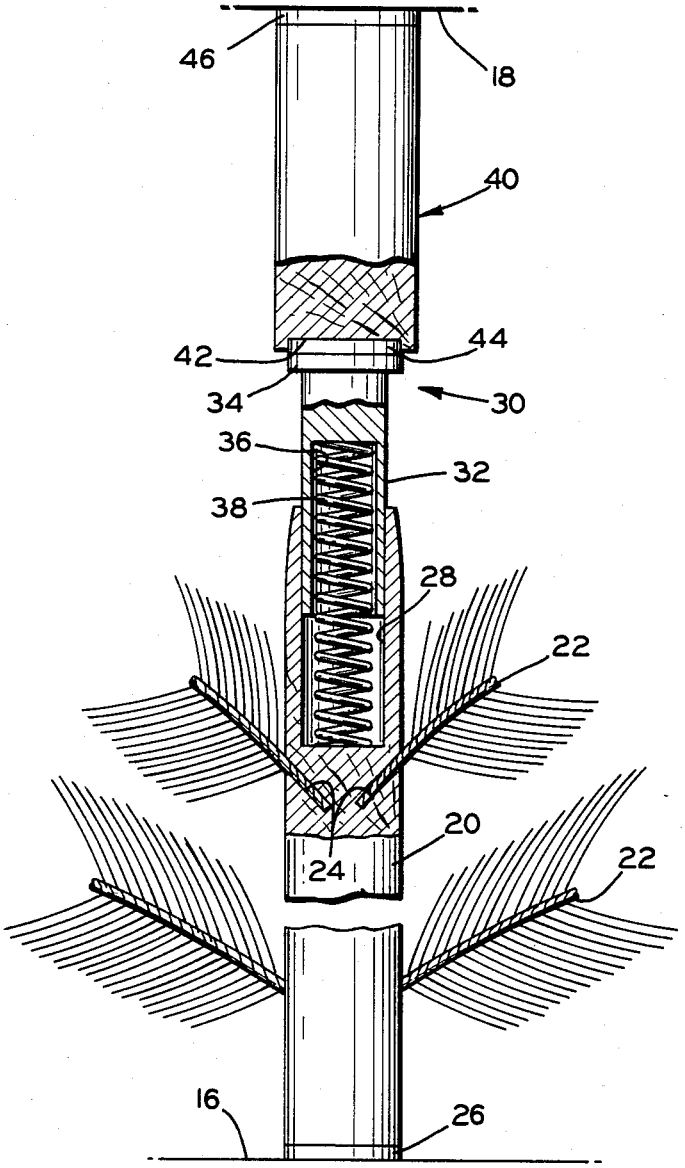
FIG. 5 is a fragmentary view of an upright supporting member of the artificial tree with parts broken away and with parts in section, with the addition of a spacing block.

Referring to the drawings, and more particularly FIG. 1, an artificial Christmas tree in accordance with the invention is indicated at 10. The tree 10 is mounted within a picture window frame indicated at 12 inside a window pane 14. More specifically, the tree 10 is pressure-mounted between an upper surface of a lower window frame member 16 and a lower surface of an upper window frame member 18. The picture window and frame can, of course, take a variety of forms and the invention is not limited to the representative form shown. Should the window frame 12 be designed such that sufficient lower and upper horizontal surfaces are not provided to receive the upright supporting member 20, suitable brackets can be affixed to the lower and upper frame members 16 and 18, between which the Christmas tree can be pressure mounted.

Figure 4:
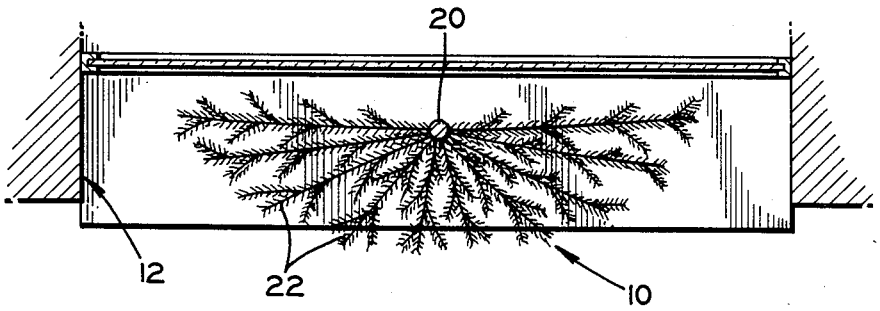
FIG. 4 is a somewhat schematic view in horizontal cross section taken through the tree, window, and frame of FIG. 3.

The Christmas tree 10 basically includes an upright supporting member or trunk 20 with a multiplicity of artificial branches 22 engaging the supporting member 20 and extending outwardly therefrom. As shown, the upright supporting member 20 is in the form of a heavy wooden pole of solid construction throughout most of its length with downwardly slanted bores 24 (FIG. 4) therein to receive the inner ends of the branches 22. As shown, the branches 22 are of known twisted wire construction with artificial needles carried thereby and extending outwardly therefrom. The tree 10 in its basic design can assume a number of different form and the invention is not to be limited to the specific one shown. Also, the usual ornaments and lights are not shown in the drawings.

The lower artificial branches 22 of the tree are longer than the upper ones to provide the usual generally triangular profile for the tree when viewed from inside or outside. The artificial branches 22 which extend generally parallel to the window pane 14 are longer than those which extend transversely and particularly perpendicularly thereto. At any given height, the branches which are perpendicular to the pane are from one-third to one-half the length of the branches parallel to the pane. This gives the tree a generally semi-elliptical shape in transverse cross section so that the tree usually consumes little of the room space beyond the window frame 12.

The artificial tree 10, which can be quite heavy when fully decorated, is pressure mounted between the lower and upper frame members 16 and 18. Toward this purpose, a resilient friction pad 26 is located at the bottom of the upright supporting member 20. To accommodate differences in picture window heights, the upper end of the supporting member has a recess or bore 28 centrally located therein. An extension member 30 includes a cylindrical plunger or barrel 32 telescopically received within the recess 28 with a resilient friction pad 34 mounted on the upper end thereof. The plunger 32 has an inner cavity 36 extending upwardly from its lower end with a coil spring 38 located both in the recess 28 and the cavity 36. The plunger 32 has an effective travel between its most fully retracted position and its most fully extended position of about six inches to accommodate various picture window heights. The pad 34 engages the lower surface of the upper frame member 18 to pressure mount the tree between the frame members. However, a cylindrical spacing member or block 40 constituting part of the extension member 30 can be used for larger picture windows. The spacing block 40 has a recess 42 at its lower end receiving a friction pad 44 with a resilient friction pad 46 located at the upper end to engage the lower surface of the frame member 18. If desired, the spacing block 40 can be furnished in two or more lengths to accommodate different sizes of window frames.

Rather than employing the coil spring 38 to urge the plunger 32 upwardly, the plunger can be threadedly engaged in the recess 28 of the upright supporting member 20 and turned outwardly to pressure mount the upright supporting member 20 with respect to the lower and upper frame members 16 and 18.

From the above, it will be seen that the artificial window-mounted Christmas tree according to the invention provides the same Christmas spirit to the occupants of the room as a full Christmas tree of generally circular shape in horizontal section and yet consumes a minimal amount of space within the room. The tree can also be seen fully from the outside and provides a decorative effect to passersby similar to that of an outside decorated tree. However, there is no need to decorate two different trees and no need to worry about vandalism. Further, with the pressure mount, the tree can be quickly put up and taken down and there is no damage to the window frame unless auxiliary brackets are needed, which seldom occurs. Even then, the brackets can be installed with one or two screws and can be fastened to and unfastened from the frame with minimal time and effort.

Various modifications of the above-described embodiments of the invention will be apparent to those skilled in the art and it is to be understood that such modifications can be made without departing from the scope of the invention, if they are within the spirit and the tenor of the accompanying claims.

I claim:

1. In combination, a window comprising a transparent pane, a lower member below said pane having a horizontal surface facing upwardly, and an upper member above said pane having a horizontal surface facing downwardly, an artificial Christmas tree comprising an upright supporting member having a lower end engaging the horizontal surface of said lower member, a plurality of artificial tree branches engaging said upright supporting member and extending outwardly therefrom, said plurality of artificial tree branches extending, in part, generally parallel to said transparent pane and extending, in part, transversely substantially only away from said transparent pane, and an extension member mounted on an upper end of said upright supporting member and movable upwardly toward the horizontal surface of said upper member.

2. The combination according to claim 1 characterized by said extension member being resiliently mounted on the upper end of said upright supporting member and urged upwardly toward the horizontal surface of said upper member.

3. The combination according to claim 1 characterized by said upright supporting member having a recess in the upper end thereof, said extension member being telescopically received in said recess.

4. The combination according to claim 3 characterized by a coil spring being located in said recess and engaged with said extension member.

5. The combination according to claim 3 characterized by said extension member having a cavity in a lower end thereof, and a coil spring located in said recess and in said cavity.

6. The combination according to claim 1 characterized by said extension member having a resilient friction pad on an upper end thereof.

7. The combination according to claim 1 characterized by said upright supporting member having a friction pad on the lower end thereof engaging the horizontal surface of said lower member.

8. The combination according to claim 1 characterized by said extension member comprising a plunger telescopically mounted on the upper end of said upright supporting member and a spacing block positioned between an upper end of said plunger and the horizontal surface of said upper member.

9. The combination according to claim 8 characterized by said spacing block having friction pads at upper and lower ends thereof.

10. The combination according to claim 1 characterized by the artificial tree branches extending transversely to the transparent pane at any given height being shorter than those extending generally parallel to the transparent pane.

11. The combination according to claim 10 characterized by the transversely extending branches which extend perpendicularly to the transparent pane being from one-fourth to one-half of the length of the parallelly extending branches.

12. An artificial Christmas tree to be mounted adjacent a picture window, said tree comprising an upright supporting member having a lower end for engagement with a lower frame member below the window, a plurality of artificial tree branches engaging said upright supporting member and extending outwardly therefrom, the branches at any given height which are adapted to extend generally parallel to the window being longer than those which are adapted to extend generally perpendicular to the window, and an extension member mounted on an upper end of said upright supporting member and movable upwardly, said extension member having an upper end for aiding in supporting said upright supporting member by an upper frame member above the window.

13. A tree according to claim 12 characterized by the branches which extend generally perpendicular to the window being from one-fourth to one-half the length of the branches which extend generally parallel to the window.

14. A tree according to claim 12 characterized by said extension member being resiliently mounted on the upper end of said upright supporting member and urged upwardly toward said upper frame member.

15. An artificial Christmas tree to be mounted adjacent the inside of a picture window comprising a transparent pane, a lower member below the pane having a horizontal surface facing upwardly, and an upper member having a horizontal surface facing downwardly, said tree comprising an upright supporting member having means at a lower end for engaging the horizontal surface of the lower frame member, a plurality of artificial tree branches supported by said upright supporting member and extending outwardly therefrom, an upper end of said supporting member having a recess therein, an extension member comprising a plunger having a cavity at one end thereof and means at the other end for engaging the horizontal surface of the upper frame member, and resilient means in said recess and said cavity for urging said extension member away from said supporting member, said extension member further comprising a spacing block adapted to be positioned between the upper end of said plunger and the horizontal surface of the upper frame member.

16. A tree according to claim 15 characterized by said spacing block having friction pads at upper and lower ends thereof.

17. An artificial Christmas tree according to claim 15 characterized by said plurality of artificial tree branches being of lengths such as to give the tree a generally semi-elliptical shape in transverse cross section.

* * * * *